US008559650B2

(12) United States Patent
Seo

(10) Patent No.: US 8,559,650 B2
(45) Date of Patent: Oct. 15, 2013

(54) CIRCUIT APPARATUS AND METHOD FOR DETECTING EARPHONE IN PORTABLE TERMINAL

(75) Inventor: Dong-Woo Seo, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 404 days.

(21) Appl. No.: 13/039,829

(22) Filed: Mar. 3, 2011

(65) Prior Publication Data

US 2011/0216912 A1 Sep. 8, 2011

(30) Foreign Application Priority Data

Mar. 5, 2010 (KR) ..... 10-2010-0019716

(51) Int. Cl.
*H04R 1/10* (2006.01)

(52) U.S. Cl.
USPC ..... 381/74; 381/77; 381/111; 381/123; 381/370; 381/375; 379/387.01; 379/388.06; 379/392.01; 379/395.01; 330/67

(58) Field of Classification Search
USPC ..... 381/74, 77, 123, 111, 370, 375; 379/387.01, 388.06, 392.01, 395.01; 330/67; 455/149, 557
See application file for complete search history.

(56) References Cited

U.S. PATENT DOCUMENTS

2011/0135109 A1* 6/2011 Park et al. ..... 381/74

* cited by examiner

*Primary Examiner* — Vivian Chin
*Assistant Examiner* — Paul Kim
(74) *Attorney, Agent, or Firm* — Jefferson IP Law, LLP

(57) ABSTRACT

A circuit apparatus and a method for detecting an earphone in a portable terminal are provided. The apparatus includes an earjack, a first switch, a second switch, a comparator, and a main chip. The earjack outputs a signal informing whether an earphone is inserted, provides a signal input from a third pole of the inserted earphone to the first switch, and provides a signal input from a fourth pole to the second switch. The first switch outputs a signal provided from the earjack to one of a comparator and a ground depending on an input control signal. The second switch outputs a signal provided from the earjack to one of the comparator and the ground depending on the input control signal. The comparator compares a voltage of a signal provided from one of the first switch and the second switch with a reference voltage to output a signal representing a comparison result. The main chip outputs the control signal depending on the signal informing whether the earphone is inserted, and one of changes and maintains the control signal depending on an output signal of the comparator.

12 Claims, 4 Drawing Sheets

CIRCUIT APPARATUS AND METHOD FOR DETECTING EARPHONE IN PORTABLE TERMINAL

PRIORITY

This application claims the benefit under 35 U.S.C. §119(a) of a Korean patent application filed in the Korean Intellectual Property Office on Mar. 5, 2010 and assigned Serial No. 10-2010-0019716, the entire disclosure of which is hereby incorporated by reference.

BACKGROUND OF THE INVENTION

1. Field of the Invention

The present invention relates to a circuit apparatus and a method for detecting an earphone in a portable terminal More particularly, the present invention relates to a circuit apparatus and a method for detecting an earphone in a portable terminal that supports both a 3.5 mm four-pole earphone for common use and a 3.5 mm four-pole earphone for use in the USA.

2. Description of the Related Art

Recently, a portable terminal that outputs a stereo sound source now supports voice communication, and also supports a 3.5 mm four-pole earphone having multiple functions in order to control functions of the portable terminal. The 3.5 mm four-pole earphone may be classified as one of a 3.5 mm four-pole earphone for common use and a 3.5 mm four-pole earphone for use in the USA, depending on its pin map.

FIG. 1 illustrates a pin map of a 3.5 mm four-pole earphone according to the related art.

Referring to FIG. 1, the pin map of the 3.5 mm four-pole earphone for common use is configured in the sequence of Left/Right/MICrophone (MIC)/GrouND (GND), and the pin map of the 3.5 mm four-pole earphone for use in the USA is configured in the sequence of Left/Right/GND/MIC. That is, the pin map of the 3.5 mm four-pole earphone for common use and the pin map of the 3.5 mm four-pole earphone for use in the USA are different in their sequence of MIC and GND.

As described above, the pin map of the 3.5 mm four-pole earphone for common use and the pin map of the 3.5 mm four-pole earphone for use in the USA are configured differently. That is, the portable terminal according to the related art includes an earjack that supports only one of the 3.5 mm four-pole earphone for common use and the 3.5 mm four-pole earphone for use in the USA as illustrated in FIG. 2.

FIG. 2 is a view illustrating an earjack that detects a 3.5 mm four-pole earphone according to the related art.

Referring to FIG. 2, an earjack that supports the 3.5 mm four-pole earphone for common use provides the third pole of an earphone as an ear mic EARMIC+ end 201, and the fourth pole as a ground GND 203. In contrast, an earjack that supports the 3.5 mm four-pole earphone for use in the USA provides the third pole of an earphone as a ground GND 211, and the fourth pole as an ear mic EARMIC+ end 213.

Accordingly, in the case of connecting the earphone for use in the USA to a portable terminal that supports the earphone for common use, or connecting the earphone for common use to a portable terminal that supports the earphone for use in the USA, the portable terminal cannot detect the earphone connected thereto. Since the earphone for common use and the earphone for use in the USA are difficult to discriminate with visual inspection, a user may misunderstand a detection problem caused by the above-described erroneous earphone insertion as a malfunction of the portable terminal.

SUMMARY OF THE INVENTION

An aspect of the present invention is to address at least the above-mentioned problems and/or disadvantages and to provide at least the advantages described below. Accordingly, an aspect of the present invention is to provide a circuit apparatus and a method for detecting an earphone in a portable terminal.

Another aspect of the present invention is to provide a circuit apparatus and a method for detecting an earphone, that support both a 3.5 mm four-pole earphone for common use and a 3.5 mm four-pole earphone for use in the USA in a portable terminal.

Still another aspect of the present invention is to provide a circuit apparatus and a method for detecting two types of 3.5 mm four-pole earphones using a 3.5 mm four-pole earjack, two switches, and a comparator in a portable terminal.

In accordance with an aspect of the present invention, an apparatus for detecting an earphone in a portable terminal is provided. The apparatus includes an earjack for outputting a signal informing whether an earphone is inserted, for providing a signal input from a third pole of the inserted earphone to a first switch, and for providing a signal input from a fourth pole to a second switch, the first switch for outputting a signal provided from the earjack to one of a comparator and a ground depending on an input control signal, the second switch for outputting a signal provided from the earjack to one of the comparator and the ground depending on the input control signal, the comparator for comparing a voltage of a signal provided from one of the first switch and the second switch with a reference voltage to output a signal representing a comparison result, and a main chip for outputting the control signal depending on the signal informing whether the earphone is inserted, and for one of changing and maintaining the control signal depending on an output signal of the comparator.

In accordance with another aspect of the present invention, a method for detecting an earphone in a portable terminal is provided. The method includes, when earphone insertion is detected, outputting a control signal, outputting signals input from a third pole and a fourth pole of the inserted earphone, respectively, to one of a comparator and a ground via a switch depending on the control signal, comparing a voltage of a signal input from one of the third pole and the fourth pole of the earphone with a reference voltage using the comparator to output a signal representing a comparison result, and one of changing and maintaining the control signal depending on the output signal representing the comparison result.

Other aspects, advantages and salient features of the invention will become apparent to those skilled in the art from the following detailed description, which, taken in conjunction with the annexed drawings, discloses exemplary embodiments of the invention.

BRIEF DESCRIPTION OF THE DRAWINGS

The above and other aspects, features, and advantages of certain exemplary embodiments of the present invention will be more apparent from the following description taken in conjunction with the accompanying drawings, in which.

Throughout the drawings, like reference numerals will be understood to refer to like parts, components and structures.

DETAILED DESCRIPTION OF EXEMPLARY EMBODIMENTS

The following description with reference to the accompanying drawings is provided to assist in a comprehensive understanding of exemplary embodiments of the invention as defined by the claims and their equivalents. It includes various specific details to assist in that understanding but these are to be regarded as merely exemplary. Accordingly, those of ordinary skill in the art will recognize that various changes and modifications of the embodiments described herein can be made without departing from the scope and spirit of the invention. Also, descriptions of well-known functions and constructions are omitted for clarity and conciseness.

The terms and words used in the following description and claims are not limited to the bibliographical meanings, but, are merely used by the inventor to enable a clear and consistent understanding of the invention. Accordingly, it should be apparent to those skilled in the art that the following description of exemplary embodiments of the present invention is provided for illustration purpose only and not for the purpose of limiting the invention as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

Exemplary embodiments of the present invention provide a circuit apparatus and a method for detecting an earphone that support both a 3.5 mm four-pole earphone for common use and a 3.5 mm four-pole earphone for use in the USA. Here, the 3.5 mm four-pole earphone for common use denotes an earphone whose pin map is configured in the sequence of Left/Right/MICrophone (MIC)/GrouND (GND), and the 3.5 mm four-pole earphone for use in the USA denotes an earphone whose pin map is configured in the sequence of Left/Right/GND/MIC.

Figure 1:
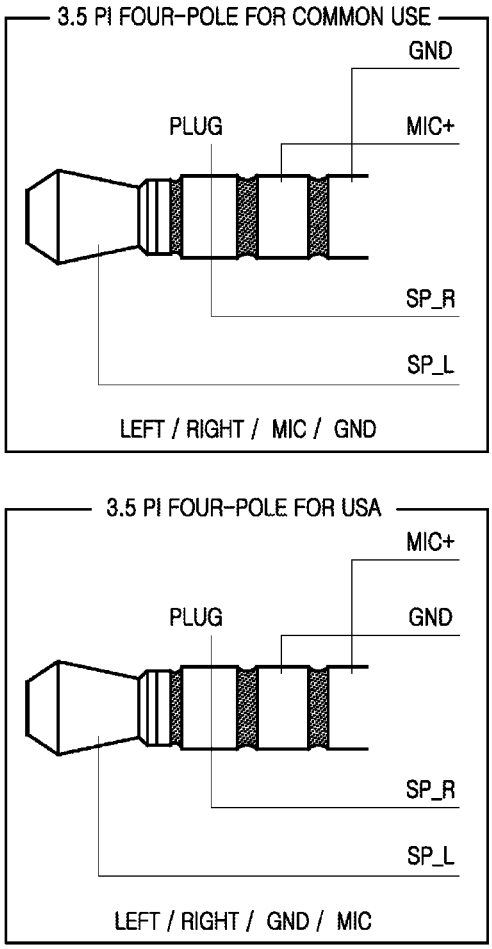
FIG.1 (RELATED ART)
FIG. 1 is a view illustrating a pin map of a 3.5 mm four-pole earphone according to the related art.
Figure 2:
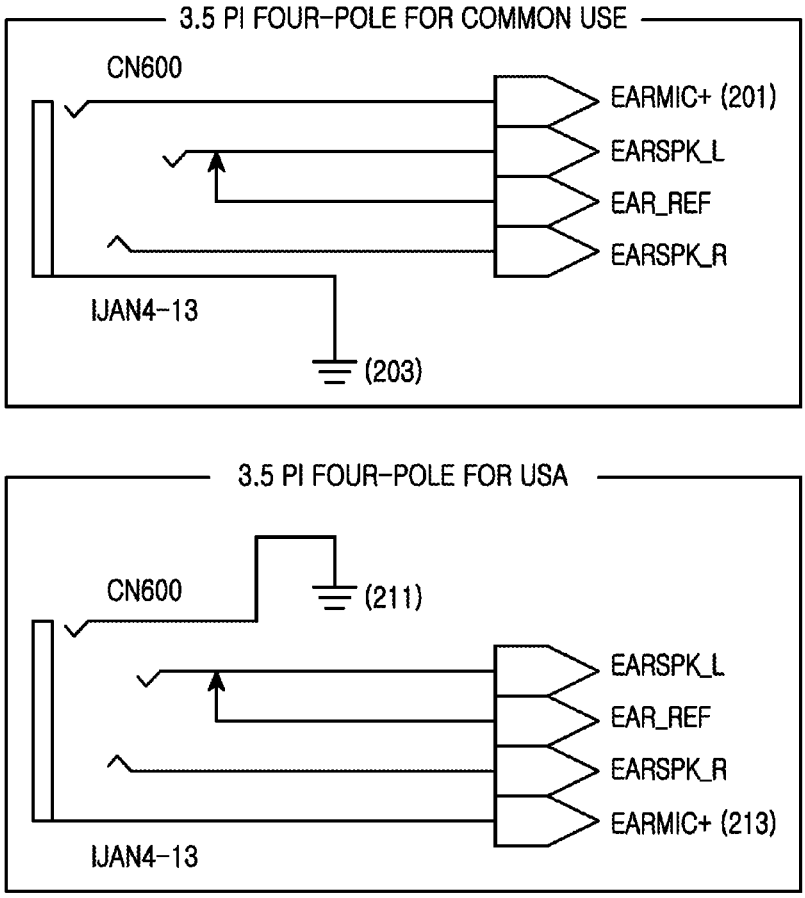
FIG.2 (RELATED ART)
FIG. 2 is a view illustrating an earjack that detects a 3.5 mm four-pole earphone according to the related art.
Figure 3:
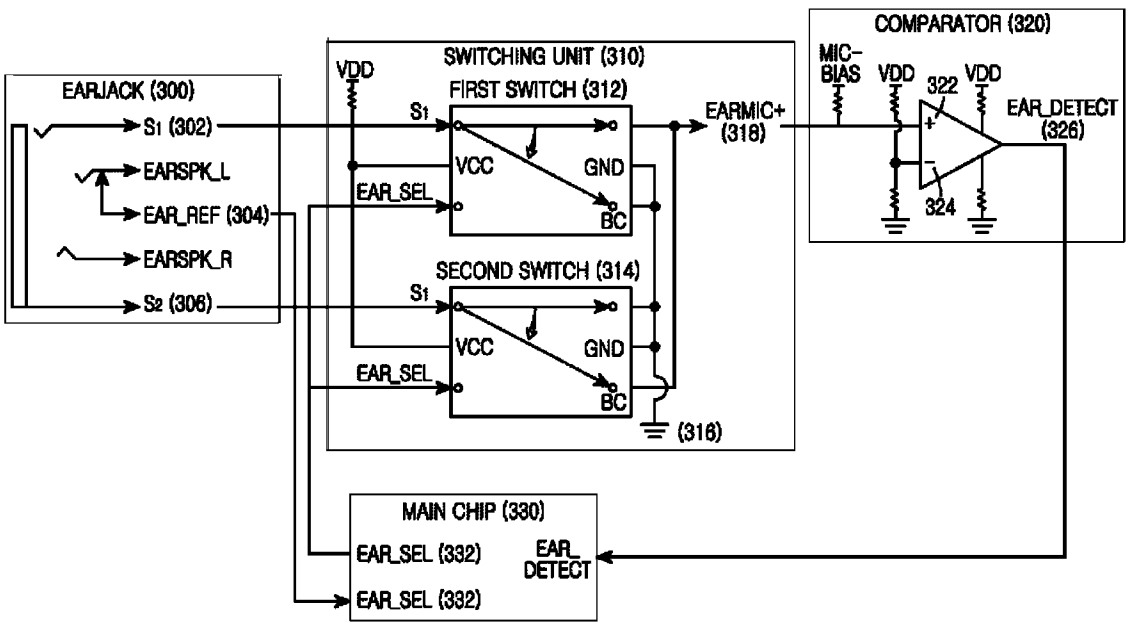
FIG. 3 is a view illustrating a construction of an earphone detection circuit in a portable terminal according to an exemplary embodiment of the present invention.

FIG. 3 is a view illustrating a construction of an earphone detection circuit in a portable terminal according to an exemplary embodiment of the present invention.

Referring to FIG. 3, the circuit apparatus for detecting an earphone in a portable terminal includes an earjack 300, a switching unit 310, a comparator 320, and a main chip 330. The switching unit 310 includes a first switch 312 and a second switch 314.

The earjack 300 is used for connecting the portable terminal with an earphone. When an earphone is inserted, the earjack 300 transfers an audio signal input from the earphone to an EARMIC+ 318. The earjack 300 provides S1 302 that receives a signal from the third pole or the fourth pole of the connected earphone to the first switch 312 of the switching unit 310, and provides S3 306 to the second switch 314 of the switching unit 310. In addition, the earjack 300 detects whether an earphone is connected to the portable terminal through EAR_REF 304 to transmit a signal, representing that the earphone is connected, to the main chip 330.

The switching unit 310 includes the first switch 312 and the second switch 314 to connect S1 302 and S2 306 of the earjack 300 to EARMIC+ 318 or GND 316 depending on an EAR_SEL signal 332 provided from the main chip 330. When an EAR_SEL signal 332 input from the main chip 330 is a low signal, the switching unit 310 connects S1 302 to EARMIC+ 318 via the first switch 312, and connects S2 306 to GND 316 via the second switch 314. In contrast, when the EAR_SEL signal 332 input from the main chip 330 is a high signal, the switching unit 310 connects S1 302 to GND 316 via the first switch 312, and connects S2 306 to EARMIC+ 318 via the second switch 314.

The comparator 320 compares a voltage of a signal input from EARMIC+ 318 connected to a + terminal 322 with a reference voltage of a signal input to a − terminal 324 to output a high or low signal. Here, the reference voltage is set to a value between a voltage value when an MIC pole of an earphone is connected to a + terminal and a voltage value when a GND pole of the earphone is connected to the + terminal. This is for determining whether the MIC pole of the earphone is connected to EARMIC+ 318 connected to the + terminal 322 or the GND pole of the earphone is connected to EARMIC+ 318. That is, when a voltage value input to the + terminal 322 is greater than the reference value of the − terminal 324, the comparator 320 outputs a high signal to EAR_DETECT 326. When a voltage value input to the + terminal 322 is smaller than the reference value of the − terminal 324, the comparator 320 outputs a low signal to EAR_DETECT 326.

The main chip 330 determines whether an earphone connected to the portable terminal is a 3.5 mm four-pole earphone for common use or a 3.5 mm four-pole earphone for use in the USA, and controls to allow the MIC pole of the connected earphone to be connected to EARMIC+ 318 and the GND pole of the connected earphone is connected to GND 316 depending on the determination result.

An operation of the main chip 330 is described in more detail. The main chip 330 receives a signal representing that earphone connection is detected via EAR_REF 304, and outputs a low signal to EAR_SEL 332 to provide the same to the first switch 312 and the second switch 314. Here, EAR_SEL 332 of the main chip is set to active-low, and accordingly, when the earphone connection is detected, EAR_SEL 332 outputs a low signal.

The main chip 330 determines whether to change a signal output from EAR_SEL 332 depending on a signal input from EAR_DETECT 326 of the comparator 320, or determines whether the connected earphone is a 3.5 mm four-pole earphone for common use or a 3.5 mm four-pole earphone for use in the USA based on the value of EAR_SEL 332.

When a signal input from EAR_DETECT 326 of the comparator 320 is a low signal, the main chip 330 converts a signal output to EAR_SEL 332 to output a high signal. In contrast, when a signal input from EAR_DETECT 326 of the comparator 320 is a high signal, the main chip 330 determines the type of the connected earphone based on a signal currently output to EAR_SEL 332. At this point, when the signal output to the EAR_SEL 332 is a low signal, the main chip 330 determines the connected earphone is a 3.5 mm four-pole earphone for common use. When the signal output to the EAR_SEL 332 is a high signal, the main chip 330 determines the connected earphone is a 3.5 mm four-pole earphone for use in the USA.

Figure 4:
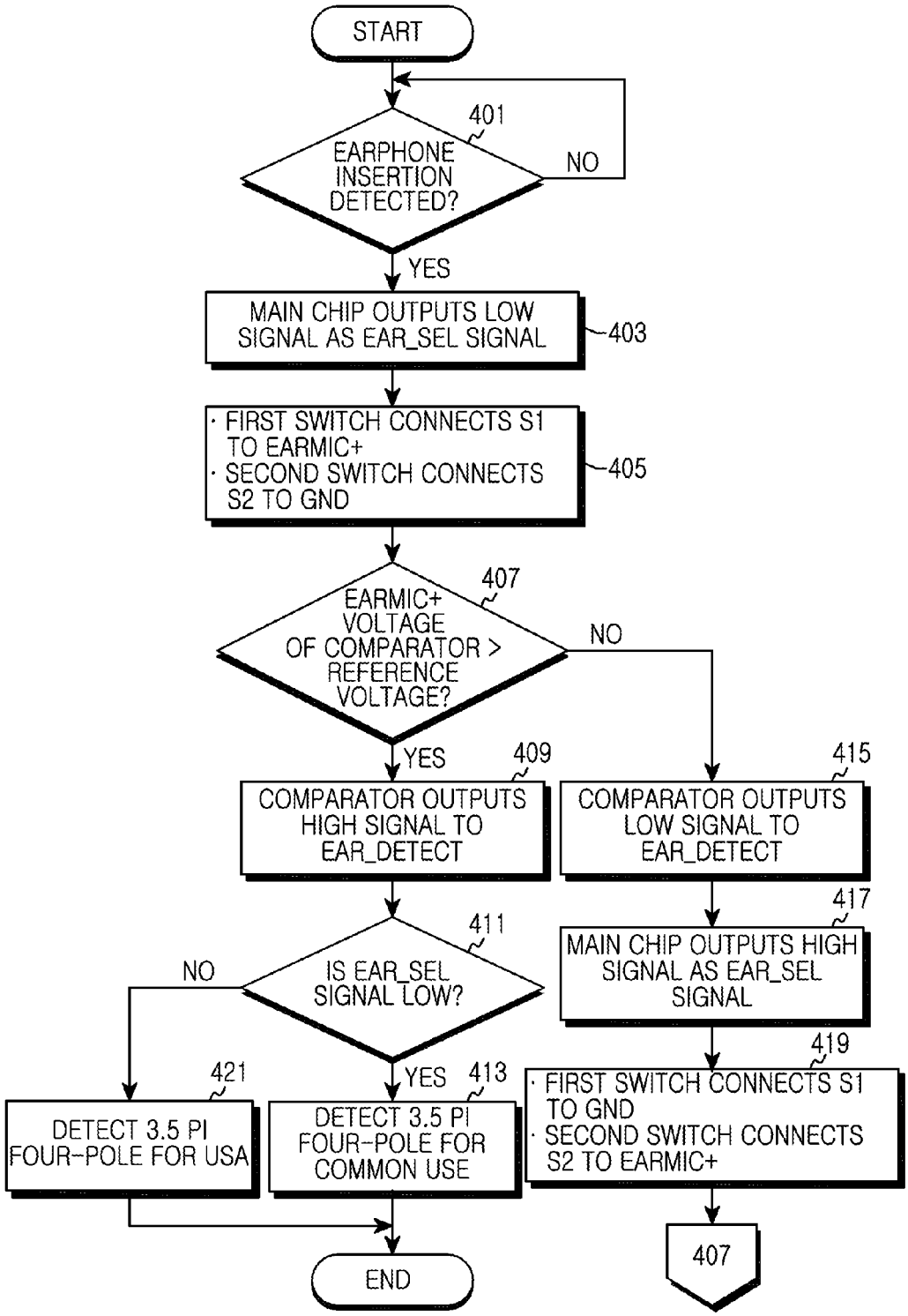
FIG. 4 is a flowchart illustrating a procedure for detecting an earphone in a portable terminal according to an exemplary embodiment of the present invention.

FIG. 4 is a flowchart illustrating a procedure for detecting an earphone in a portable terminal according to an exemplary embodiment of the present invention.

Referring to FIG. 4, the terminal detects whether an earphone is inserted in step 401. Here, whether the earphone is inserted may be detected through a signal of EAR_REF 304 of the earjack 300 of the terminal.

When the earphone is inserted, the terminal outputs a low signal to EAR_SEL via the main chip in step 403, connects S1 302 that receives an input from a third pole of the earphone via the first switch 312 to EARMIC+ 318, that is, an input of the comparator, and connects S2 306 that receives an input from a fourth pole of the earphone to GND 316 via the second switch 314 in step 405.

The terminal determines whether a voltage value of EARMIC+ 318 input to the + terminal 322 of the comparator 320 is greater than the reference voltage value input to the – terminal 324 in step 407.

When the voltage value input to the + terminal 322 of the comparator 320 is smaller than the reference voltage value input to the – terminal 324, the terminal outputs a low signal via the comparator 320 and transfers the same to the main chip 330 in step 415. The terminal changes the EAR_SEL signal to a high signal via the main chip 330 in step 417, connects S1 302 that receives an input from a third pole of an earphone via the first switch 312 to GND 316, and connects S2 306 that receives an input from a fourth pole of the earphone via the second switch 314 to EARMIC+ 318, that is, an input of the comparator in step 419. The terminal returns to step 407 to re-perform subsequent steps.

In contrast, when the voltage value input to the + terminal 322 of the comparator 320 is greater than the reference voltage value input to the – terminal 324, the terminal outputs a high signal via the comparator 320 and transfers the same to the main chip 330 in step 409.

After that, the terminal determines whether a signal output to EAR_SEL 332 is a low signal via the main chip 330 in step 411. When a low signal is output to EAR_SEL 332, the terminal detects that the inserted earphone is for a 3.5 mm four-pole earphone for common use in step 413. When a high signal is output to EAR_SEL 332, the terminal detects that the inserted earphone is for a 3.5 mm four-pole earphone for use in the USA in step 421, and ends the algorithm according to an exemplary embodiment of the present invention.

Exemplary embodiments of the present invention allow a user to use both a 3.5 mm four-pole earphone for common use and a 3.5 mm four-pole earphone for use in the USA in a portable terminal by providing a circuit apparatus and a method, for detecting an earphone, that support both the 3.5 mm four-pole earphone for common use and the 3.5 mm four-pole earphone for use in the USA in the portable terminal. Therefore, consumer satisfaction may improve.

While the invention has been shown and described with reference to certain exemplary embodiments thereof, it will be understood by those skilled in the art that various changes in form and details may be made therein without departing from the spirit and scope of the invention as defined by the appended claims and their equivalents.

What is claimed is:

1. An apparatus for detecting an earphone in a portable terminal, the apparatus comprising:

an earjack for outputting a signal informing whether an earphone is inserted, for providing a signal input from a third pole of the inserted earphone to a first switch, and for providing a signal input from a fourth pole to a second switch;

the first switch for outputting a signal provided from the earjack to one of a comparator and a ground depending on an input control signal;

the second switch for outputting a signal provided from the earjack to one of the comparator and the ground depending on the input control signal;

the comparator for comparing a voltage of a signal provided from one of the first switch and the second switch with a reference voltage to output a signal representing a comparison result; and a main chip for outputting the control signal depending on the signal informing whether the earphone is inserted, and for one of changing and maintaining the control signal depending on an output signal of the comparator.

2. The apparatus of claim 1, wherein the main chip detects a type of the inserted earphone according to the control signal.

3. The apparatus of claim 2, wherein the type of the earphone is one of a four-pole earphone whose pin map is configured in the sequence of Left/Right/MICrophone (MIC)/GrouND (GND) and a four-pole earphone whose pin map is configured in the sequence of Left/Right/GND/MIC.

4. The apparatus of claim 1, wherein when the first switch outputs a signal provided from the earjack to the comparator according to the control signal, the second switch outputs a signal provided from the earjack to the ground according to the control signal, and when the first switch outputs a signal provided from the earjack to the ground according to the control signal, the second switch outputs a signal provided from the earjack to the comparator according to the control signal.

5. The apparatus of claim 1, wherein the reference voltage of the comparator is set to a value between a voltage value when a microphone pole of the earphone is connected to one of ends of the comparator, and a voltage value when a ground pole of the earphone is connected to one of the ends of the comparator.

6. The apparatus of claim 1, wherein when an output signal of the comparator is a signal representing that a microphone pole of the earphone is connected to the comparator, the main chip maintains the control signal, and when an output signal of the comparator is a signal representing that the ground pole of the earphone is connected to the comparator, the main chip changes the control signal.

7. A method for detecting an earphone in a portable terminal, the method comprising:

when earphone insertion is detected, outputting a control signal;

outputting signals input from a third pole and a fourth pole of the inserted earphone, respectively, to one of a comparator and a ground via a switch depending on the control signal;

comparing a voltage of a signal input from one of the third pole and the fourth pole of the earphone with a reference voltage using the comparator to output a signal representing a comparison result; and one of changing and maintaining the control signal depending on the output signal representing the comparison result.

8. The method of claim 7, further comprising detecting a type of the inserted earphone according to the one of the changed and maintained control signal.

9. The method of claim 8, wherein the type of the earphone is one of a four-pole earphone whose pin map is configured in the sequence of Left/Right/MICrophone (MIC)/GrouND (GND) and a four-pole earphone whose pin map is configured in the sequence of Left/Right/GND/MIC.

10. The method of claim 7, wherein the outputting of the signals input from the third pole and the fourth pole of the inserted earphone, respectively, to one of the comparator and the ground via the switch depending on the control signal comprises:

outputting a signal provided from the third pole of the earphone to the comparator and outputting a signal provided from the fourth pole of the earphone to the ground according to the control signal; and outputting a signal provided from the third pole of the earphone to the ground, and outputting a signal provided from the fourth pole of the earphone to the comparator according to the control signal.

11. The method of claim 7, wherein the reference voltage of the comparator is set to a value between a voltage value when a microphone pole of an earphone is connected to one of ends of the comparator, and a voltage value when a ground pole of the earphone is connected to one of the ends of the comparator.

12. The method of claim 7, wherein the changing or maintaining of the control signal comprises:

when a signal representing the comparison result is a signal representing a microphone pole of the earphone is connected to the comparator, maintaining the control signal; and when a signal representing the comparison result is a signal representing a ground pole of the earphone is connected to the comparator, changing the control signal.

* * * * *